US012007214B1

(12) United States Patent
Aubuchon

(10) Patent No.: US 12,007,214 B1
(45) Date of Patent: Jun. 11, 2024

(54) AUTO-GAUGE AMMUNITION INSPECTION SYSTEM

(71) Applicant: James Aubuchon, Reno, NV (US)

(72) Inventor: James Aubuchon, Reno, NV (US)

( * ) Notice: Subject to any disclaimer, the term of this patent is extended or adjusted under 35 U.S.C. 154(b) by 0 days.

(21) Appl. No.: 18/141,364

(22) Filed: Apr. 28, 2023

Related U.S. Application Data

(63) Continuation-in-part of application No. 18/133,159, filed on Apr. 11, 2023, now abandoned.

(51) Int. Cl.
*F42B 35/00* (2006.01)
*F42B 35/02* (2006.01)

(52) U.S. Cl.
CPC ..... *F42B 35/00* (2013.01); *F42B 35/02* (2013.01)

(58) Field of Classification Search
CPC ..... F42B 35/00; F42B 35/02; F42B 33/00–14
See application file for complete search history.

(56) References Cited

U.S. PATENT DOCUMENTS 2,300,361 A * 10/1942 Reynolds ..... F42B 35/00 73/167
2,318,856 A * 5/1943 Hoffman ..... B07C 5/00 250/214 R
2,663,421 A * 12/1953 Reynolds ..... F42B 33/0207 156/320
2,768,743 A * 10/1956 White ..... F42B 35/02 209/601
3,019,688 A * 2/1962 Hunt ..... F42B 35/00 346/25
3,844,162 A * 10/1974 Picozzi ..... G01B 13/00 33/1 BB
4,923,066 A * 5/1990 Ophir ..... F42B 35/00 209/556
8,416,403 B2 * 4/2013 Nygaard ..... G01N 21/952 356/601
2010/0245850 A1 * 9/2010 Lee ..... G01B 11/08 356/625
2017/0184383 A1 * 6/2017 Lee ..... H04N 23/56

FOREIGN PATENT DOCUMENTS

CN 108458631 A * 8/2018 ..... F42B 35/02
CN 110398186 A * 11/2019 ..... F42B 33/02

* cited by examiner

*Primary Examiner* — Gabriel J. Klein
(74) *Attorney, Agent, or Firm* — QuickPatents; Kevin Prince

(57) ABSTRACT

A system and apparatus that facilitate automating and increasing the efficiency of ammunition case gauge inspection and testing. A fully interchangeable and mated cartridge case guide chute and cartridge case gauge plate assembly are provided to easily and rapidly change between various ammunition calibers for the automated inspection of ammunition. Variable speed control provides for synchronization of the auto-gauge ammunition inspection system with the source of the manufactured ammunition for inspection.

19 Claims, 9 Drawing Sheets

AUTO-GAUGE AMMUNITION INSPECTION SYSTEM

CROSS-REFERENCE TO RELATED APPLICATIONS

This application is a Continuation-in-Part of U.S. patent application Ser. No. 18/133,159, filed on Apr. 11, 2023, which claims the benefit of U.S. Provisional Patent Application 63/331,391, filed on Apr. 15, 2022, both being incorporated herein by reference.

STATEMENT REGARDING FEDERALLY SPONSORED RESEARCH AND DEVELOPMENT

Not Applicable.

FIELD OF THE INVENTION

The present invention relates generally to ammunition inspection, and more particularly, to an auto-gauge ammunition inspection system that facilitates the sorting, testing and inspection of the size and dimensions of ammunition.

BACKGROUND

Guns and ammunition have been around for a long time. Indeed, the first devices identified as guns appeared in China from around CE 1000, and by the 12th century, gun technology was spreading through the rest of Asia, and into Europe. The American Revolution was fought and won with guns, and the weapons have become ingrained in culture of the United States. A round of ammunition (also known as a "cartridge") normally includes a case which includes a primer, a quantity of powder contained within the case, and a projectile held in the open end of the case. Upon the striking of the primer by the firing pin of the weapon a flame is generated that ignites the powder within the case, generating gases which expand and propel the projectile from the muzzle of the weapon. Normally, the cartridge is geometrically shaped and sized to be contained within the chamber of the weapon, and the projectile has dimensions which allows the cartridge to fit in the breech end of the barrel, and to eventually pass through the barrel upon firing of the round.

For many rifles, for example, it is common to make the case of the round of ammunition of a size which will provide for maximum force with which the projectile is propelled from the rifle to the target. Thus, it is common, for a round for a given caliber weapon, to employ a case which will contain a maximum amount of powder. As such, the case has a large diameter relative to the diameter of the projectile employed. This case then becomes the "standard" case for a particular caliber weapon (e.g., a 9 MM handgun) and weapons of this caliber are chambered to accept this standard case. Standards for the shape and size of a cartridge for a given weapon of a given caliber are established and published by standards setting bodies such as the Sporting Arms and Ammunition Manufacturers' Institute (SAAMI), the National Institute of Standards and Technology (NIST), and the North Atlantic Treaty Organization (NATO).

Not surprisingly, ammunition inspection is a critical undertaking in the manufacturing process for ensuring overall quality and safety. In many cases, such as in police and military operations, proper ammunition inspection that ensures a quality ammunition round has been chambered can be a life or death matter. If a firearm user's ammunition has defects (e.g., pinholes or cracks in the cartridge casings and/or cocked primers, this firearm could be in serious trouble in terms of a firing malfunction. As such, a case gauge is an effective tool for diagnosing and troubleshooting possible ammunition related issues with firearms. Case gauges are generally used by manufacturers, reloaders or handloaders (e.g., individuals who make their own ammunition) as a quick test for checking oversized or undersized brass. Such gauges are also extremely useful for checking the size of the case on loaded ammunition as well.

Headspace is a measurement that determines what the cartridge "stops against" when chambered, and any corresponding dimensions/tolerances. In the case of bottleneck rifle cartridges this dimension is between a "datum line" on the shoulder on the front side, and the bolt face on the back side. The datum line corresponds to a portion of the shoulder on the case of known diameter. In this way, the case gauge measures case overall length based on the shoulder, a function of headspace dimensions. That is, this is checking to see if the cartridge will properly chamber, and the case gauge is checking the "datum to head" length between the case shoulder and the case rim. For example, if the case rim for the case/cartridge that is undergoing checking protrudes above the maximum length surface of the case gauge, there is no guarantee that the completed cartridge will chamber properly. Conversely, if the case rim falls below the minimum surface of the case gauge, the case shoulder will not be tight in the chamber of the fireman which negatively impacts accuracy. Defects in ammunition can lead to issues with respect to chambering, feeding, extracting, and/or ejecting ammunition from a firearm. Accordingly, there are numerous manual and automated techniques directed to ammunition quality and the inspection of casings, primers, and other ammunition features, ensuring the safety of the gun user and the integrity of the ammunition manufacturer's product. Of course, with the continual increase in ammunition sales and in some cases ammunition shortages there remains a constant need for improved ammunition inspection techniques.

Accordingly, there is need for an improved technique for automating and increasing the efficiency of ammunition case gauge inspection and testing. The present invention accomplishes these objectives.

SUMMARY OF THE INVENTION

The present invention is directed to a system and apparatus that facilitate automating and increasing the efficiency of ammunition case gauge inspection and testing.

In a first implementation of the invention, an auto-gauge ammunition inspection system is provided that facilitates automating and increasing the efficiency of ammunition case gauge inspection and testing, the auto-gauge ammunition inspection system comprising:

- a cartridge case gauge plate comprising a plurality of precision reamed cartridge chambers embedded and fabricated therein, each precision reamed cartridge chamber conforming with a specific ammunition caliber specification and accepting a particular one cartridge of a plurality of cartridges, and for confirming whether each respective cartridge of the plurality of cartridges conforms with the specific ammunition caliber specification;
- a cartridge guide chute, in a first position proximate to and above the cartridge case gauge plate, configured for use with the specific ammunition caliber specification and for receiving, orienting, and guiding each respective cartridge of the plurality of cartridges such that each respective cartridge travels along a path through the cartridge guide chute for dropping into a particular one precision reamed cartridge chamber of the plurality of precision reamed cartridge chambers in the cartridge case gauge plate;

a motor assembly coupled with the cartridge case gauge plate and for driving the cartridge case gauge plate in a revolving motion such that the particular one cartridge of the plurality of cartridges drops from the cartridge guide chute as the cartridge case gauge plate revolves thereunder into the particular one precision reamed cartridge chamber of the plurality of reamed cartridge chambers;

a first testing station comprising a micro-limit switch, a push-pull solenoid, and a gate controllable by the micro-limit switch and the push-pull solenoid between an open gate position and a closed gate position, wherein the micro-limit switch is in a second position proximate to and above the cartridge case gauge plate and configured for detecting an improper cartridge case size condition and a high primer condition or overlength cartridge for the particular one cartridge of the plurality of cartridges dropped into the particular one precision reamed cartridge chamber from the cartridge guide chute as the cartridge case gauge plate revolves, and in the event of the detection of either of the improper cartridge case size condition or the high primer condition for the particular one cartridge activating the push-pull solenoid and placing the gate in the open gate position from the closed gate position for ejecting the particular one cartridge into a first bin; and a second testing station comprising a pair of pressure sensors for detecting a missing primer condition and a misoriented primer condition for the particular one cartridge of the plurality of cartridges dropped into the particular one precision reamed cartridge chamber from the cartridge guide chute as the cartridge case gauge plate revolves but only if the particular one cartridge was not ejected first by the first testing station, wherein the pair of pressure sensors are configured for triggering a second push-pull solenoid and placing the gate in the open gate position from the closed gate position for ejecting the particular cartridge into a second bin, but if neither of the missing primer condition or the misoriented primer condition is detected then removing the particular one cartridge into a third bin. The third bin is the final step in testing and represents quality validated cartridges.

In a second implementation of the invention, a method is provided for automating and increasing the efficiency of ammunition case gauge inspection and testing, the method comprising:

(i) receiving a plurality of cartridges from a cartridge loader; (ii) providing an auto-gauge ammunition inspection system a cartridge case gauge plate comprising a plurality of precision reamed cartridge chambers embedded and fabricated therein, each precision reamed cartridge chamber conforming with a specific ammunition caliber specification and accepting a particular one cartridge of the plurality of cartridges, and for confirming whether each respective cartridge of the plurality of cartridges conforms with the specific ammunition caliber specification; a cartridge guide chute, in a first position proximate to and above the cartridge case gauge plate, configured for use with the specific ammunition caliber specification and for receiving, orienting, and guiding each respective cartridge of the plurality of cartridges such that each respective cartridge travels along a path through the cartridge guide chute for dropping into a particular one precision reamed cartridge chamber of the plurality of precision reamed cartridge chambers in the cartridge case gauge plate; a motor assembly coupled with the cartridge case gauge plate and for driving the cartridge case gauge plate in a revolving motion such that the particular one cartridge of the plurality of cartridges drops from the cartridge guide chute as the cartridge case gauge plate revolves thereunder into the particular one precision reamed cartridge chamber of the plurality of reamed cartridge chambers; a first testing station comprising a micro-limit switch, a push-pull solenoid, and a gate controllable by the micro-limit switch and the push-pull solenoid between an open gate position and a closed gate position, wherein the micro-limit switch is in a second position proximate to and above the cartridge case gauge plate and configured for detecting an improper cartridge case size condition and a high primer condition for the particular one cartridge of the plurality of cartridges dropped into the particular one precision reamed cartridge chamber from the cartridge guide chute as the cartridge case gauge plate revolves, and in the event of the detection of either of the improper cartridge case size condition or the high primer condition for the particular one cartridge activating the push-pull solenoid and placing the gate in the open gate position from the closed gate position for ejecting the particular one cartridge into a first bin; and a second testing station comprising a pair of pressure sensors for detecting a missing primer condition and a misoriented primer condition for the particular one cartridge of the plurality of cartridges dropped into the particular one precision reamed cartridge chamber from the cartridge guide chute as the cartridge case gauge plate revolves but only if the particular one cartridge was not ejected first by the first testing station, wherein the pair of pressure sensors are configured for triggering a stoppage of the revolving of the cartridge case gauge plate and sounding an alarm in the event of the detection of either of the missing primer condition or the misoriented primer condition for a removal of the particular one cartridge and resetting the cartridge case gauge plate, but if neither of the missing primer condition or the misoriented primer condition is detected then removing the particular one cartridge into a second bin; and (iii) distributing contents of the first bin and the second bin.

In another aspect, the cartridge case gauge plate comprises a circular shape and the plurality of precision reamed cartridge chambers comprise six (6) precision reamed cartridge chambers positioned in symmetric fashion about a circumference of the circular shape.

In another aspect, the specific ammunition caliber specification is a Sporting Arms and Ammunition Manufacturers' Institute (SAAMI) ammunition specification, a National Institute of Standards and Technology (NIST) ammunition specification, or a North Atlantic Treaty Organization (NATO) ammunition specification.

In another aspect, the plurality of cartridges are received by the cartridge guide chute from a cartridge loader.

In another aspect, wherein the cartridge guide chute further comprises: a funnel having a circular top portion and a narrow short tube bottom portion; a flexible spring tube portion having a first end and a second end facilitating adjusting of the first position proximate to and above the cartridge case gauge plate for the cartridge guide chute a rigid tube portion having a first end and a second end; and wherein the first end of the flexible spring tube portion is connected with the short tube bottom portion of the funnel and the second end of the flexible spring portion is connected with the first end of the rigid tube portion.

In another aspect, the cartridge guide chute orients and guides each respective cartridge of the plurality of cartridges in a nose-down position along the path through the cartridge guide chute as each respect cartridge travels therethrough.

In another aspect, the rigid tube portion forms a stack of the respective cartridges of the plurality of cartridges travelling through the cartridge guide chute.

In another aspect, the particular one cartridge drops from the stack of cartridges into the particular one precision reamed cartridge chamber from the cartridge guide chute as the cartridge case gauge plate revolves thereunder.

In another aspect, the motor assembly uses a variable speed in the driving of the cartridge case gauge plate in a revolving motion.

In another aspect, the first bin is configured for storing one or more rejected cartridges from the plurality of cartridges as non-compliant with the specific ammunition caliber specification, and the second bin is configured for storing one or more rejected cartridges from the plurality of cartridges as compliant with the specific ammunition caliber specification.

In another aspect, the second testing station triggers the sounding of the alarm substantially contemporaneously with the triggering of a stoppage of the revolving of the cartridge case gauge plate in the event of the detection of either of the missing primer condition or the misoriented primer condition.

In another aspect, the improper case size condition and the high primer condition for the particular one cartridge of the plurality of cartridges exists when the particular one cartridge of the plurality of cartridges dropped into the particular one precision reamed cartridge chamber from the cartridge guide chute as the cartridge case gauge plate revolves thereunder extends beyond the particular one precision reamed cartridge chamber.

In another aspect, the auto-gauge ammunition inspection system further comprises: a control board for controlling at least the motor assembly and the push-pull solenoid; and a base unit mechanically connected by a shaft with the cartridge case gauge plate for holding the control board, the motor assembly, and the push-pull solenoid therein, the shaft configured for being driven by the motor assembly.

In another aspect, the second testing station further comprises: a pressure sensor bracket for mechanically connecting the second testing station to the base unit; a threaded adjustment screw comprising a wing nut for driving the threaded adjustment screw into the base unit; a set of lock nuts for mechanically connecting the pair of pressure sensors to the pressure sensor bracket; and a hinge for facilitating a swinging movement of the pressure sensor bracket about the base unit in order to remove the cartridge case gauge plate from the auto-gauge ammunition inspection system.

In another aspect, the first testing station further comprises: a micro-switch bracket having a channel for mechanically connecting the first testing station to the base unit.

In another aspect, the auto-gauge ammunition inspection system further comprises: a cartridge guide chute bracket comprising a channel and an adjustable portion for mechanically connecting the cartridge chute to the base unit, the cartridge chute being disposed within the channel; and an adjustable locking bolt for adjusting the adjustable portion of the cartridge guide chute bracket for configuring the cartridge guide chute in the first position proximate to and above the cartridge case gauge plate.

These and other objects, features, and advantages of the present invention will become more readily apparent from the attached drawings and the detailed description of the preferred embodiments, which follow.

DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENT

Figure 1:
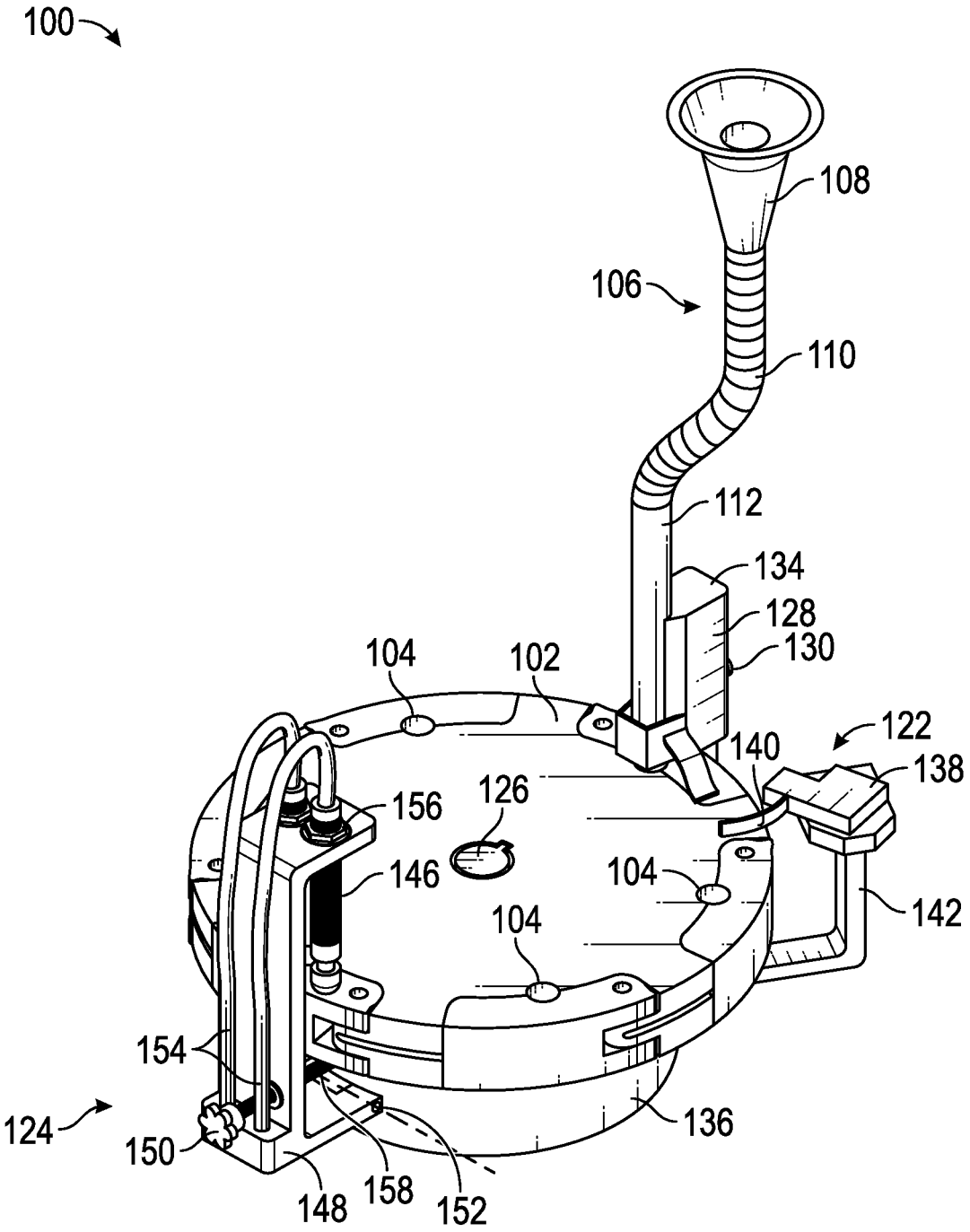
FIG. 1 presents a front, left isometric view of an auto-gauge ammunition inspection system in accordance with an illustrative embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a system and apparatus that facilitate automating and increasing the efficiency of ammunition case gauge inspection and testing. More particularly, an auto-gauge ammunition inspection system is provided comprising at least: a cartridge case gauge plate comprising a plurality of precision reamed cartridge chambers embedded and fabricated therein, each precision reamed cartridge chamber conforming with a specific ammunition caliber specification and accepting a particular one cartridge of a plurality of cartridges, and for confirming whether each respective cartridge of the plurality of cartridges conforms with the specific ammunition caliber specification; a cartridge guide chute, in a first position proximate to and above the cartridge case gauge plate, configured for use with the specific ammunition caliber specification and for receiving, orienting, and guiding each respective cartridge of the plurality of cartridges such that each respective cartridge travels along a path through the cartridge guide chute for dropping into a particular one precision reamed cartridge chamber of the plurality of precision reamed cartridge chambers in the cartridge case gauge plate; a motor assembly coupled with the cartridge case gauge plate and for driving the cartridge case gauge plate in a revolving motion such that the particular one cartridge of the plurality of cartridges drops from the cartridge guide chute as the cartridge case gauge plate revolves thereunder into the particular one precision reamed cartridge chamber of the plurality of reamed cartridge chambers; a first testing station comprising a micro-limit switch, a push-pull solenoid, and a gate controllable by the micro-limit switch and the push-pull solenoid between an open gate position and a closed gate position, wherein the micro-limit switch is in a second position proximate to and above the cartridge case gauge plate and configured for detecting an improper cartridge case size condition and a high primer condition for the particular one cartridge of the plurality of cartridges dropped into the particular one precision reamed cartridge chamber from the cartridge guide chute as the cartridge case gauge plate revolves, and in the event of the detection of either of the improper cartridge case size condition or the high primer condition for the particular one cartridge activating the push-pull solenoid and placing the gate in the open gate position from the closed gate position for ejecting the particular one cartridge into a first bin; and a second testing station comprising a pair of pressure sensors for detecting a missing primer condition and a misoriented primer condition for the particular one cartridge of the plurality of cartridges dropped into the particular one precision reamed cartridge chamber from the cartridge guide chute as the cartridge case gauge plate revolves but only if the particular one cartridge was not ejected first by the first testing station, wherein the pair of pressure sensors are configured for triggering a second push-pull solenoid and ejecting the cartridge into a second bin, but if neither of the missing primer condition or the misoriented primer condition is detected then removing the particular one cartridge into a third bin. In accordance with the disclosed embodiments, improvements are made to ammunition inspection in terms of improved ammunition validation upon the manufacture thereof and compliance with application ammunition gauge specifications (e.g., .22 caliber, .38 caliber, 9 MM, etc.). In this way, in accordance with the principles of the disclosed embodiments, a fully interchangeable and mated cartridge case guide chute and cartridge case gauge plate assembly are provided to easily and rapidly change between various ammunition calibers for the automated inspection of ammunition. Variable speed control provides for synchronization of the auto-gauge ammunition inspection system with the source of the manufactured ammunition for inspection (e.g., a cartridge loader). In this way, large quantities of manufactured ammunition, up to the rate of 3,600 cartridges per hour, may be inspected for quality and adherence to application ammunition specifications thereby increasing overall quality control and reducing liability from defective ammunition when used in a firearm (e.g., handguns and/or rifles) in terms of human injury from a firearm malfunction and/or damaging the respective firearm.

Figure 2:
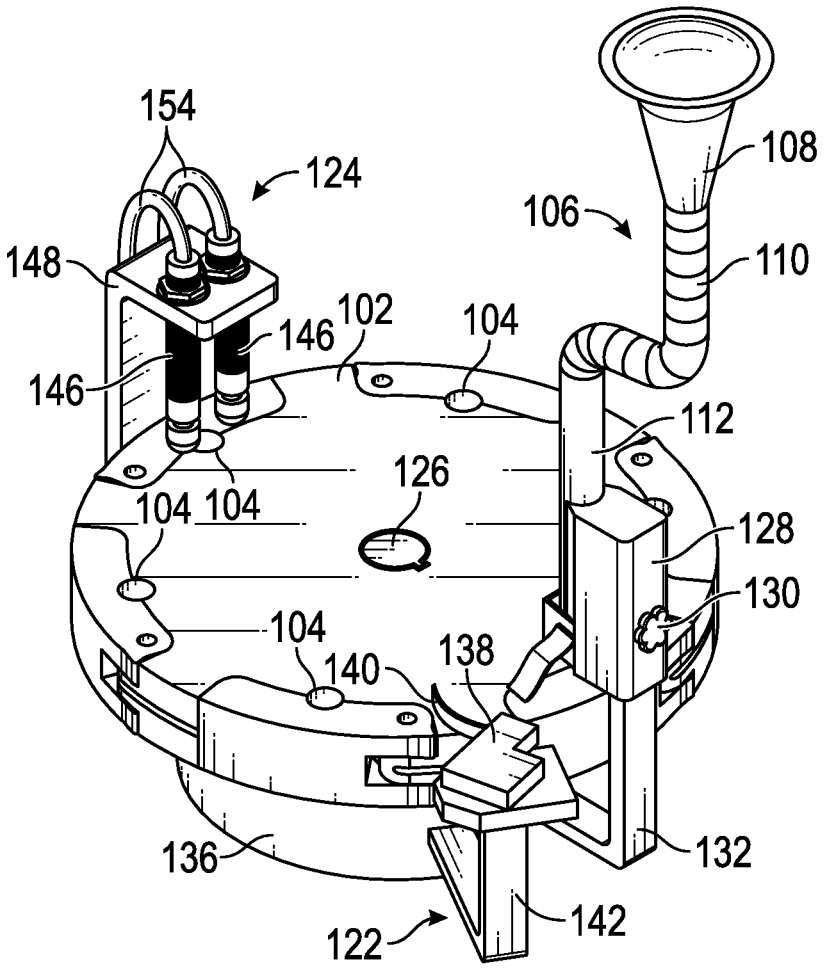
FIG. 2 presents a front, right isometric view of an auto-gauge ammunition inspection system in accordance with an illustrative embodiment of the present invention.
Figure 3:
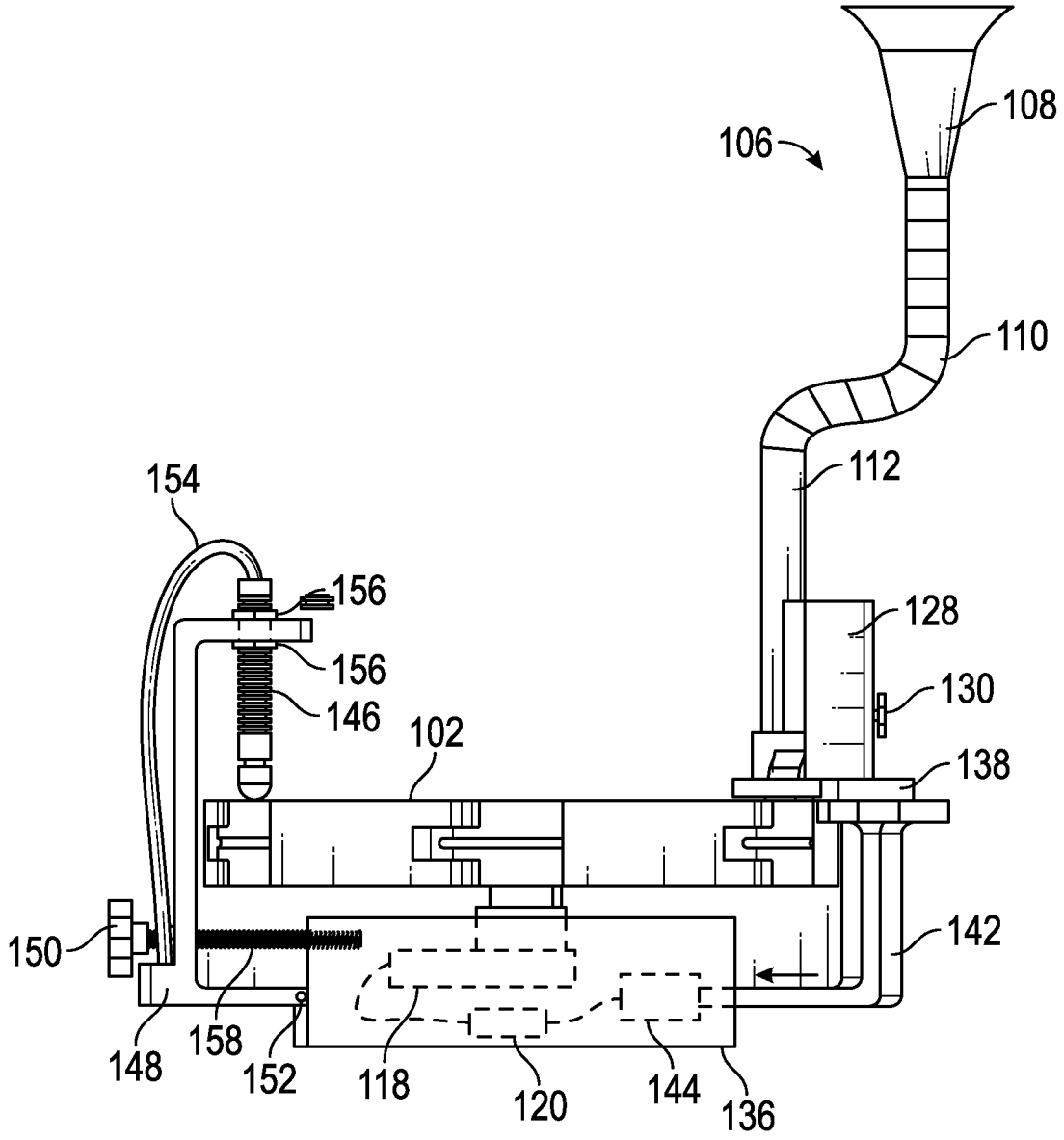
FIG. 3 presents an elevation view of an auto-gauge ammunition inspection system in accordance with an illustrative embodiment of the present invention.
Figure 4:
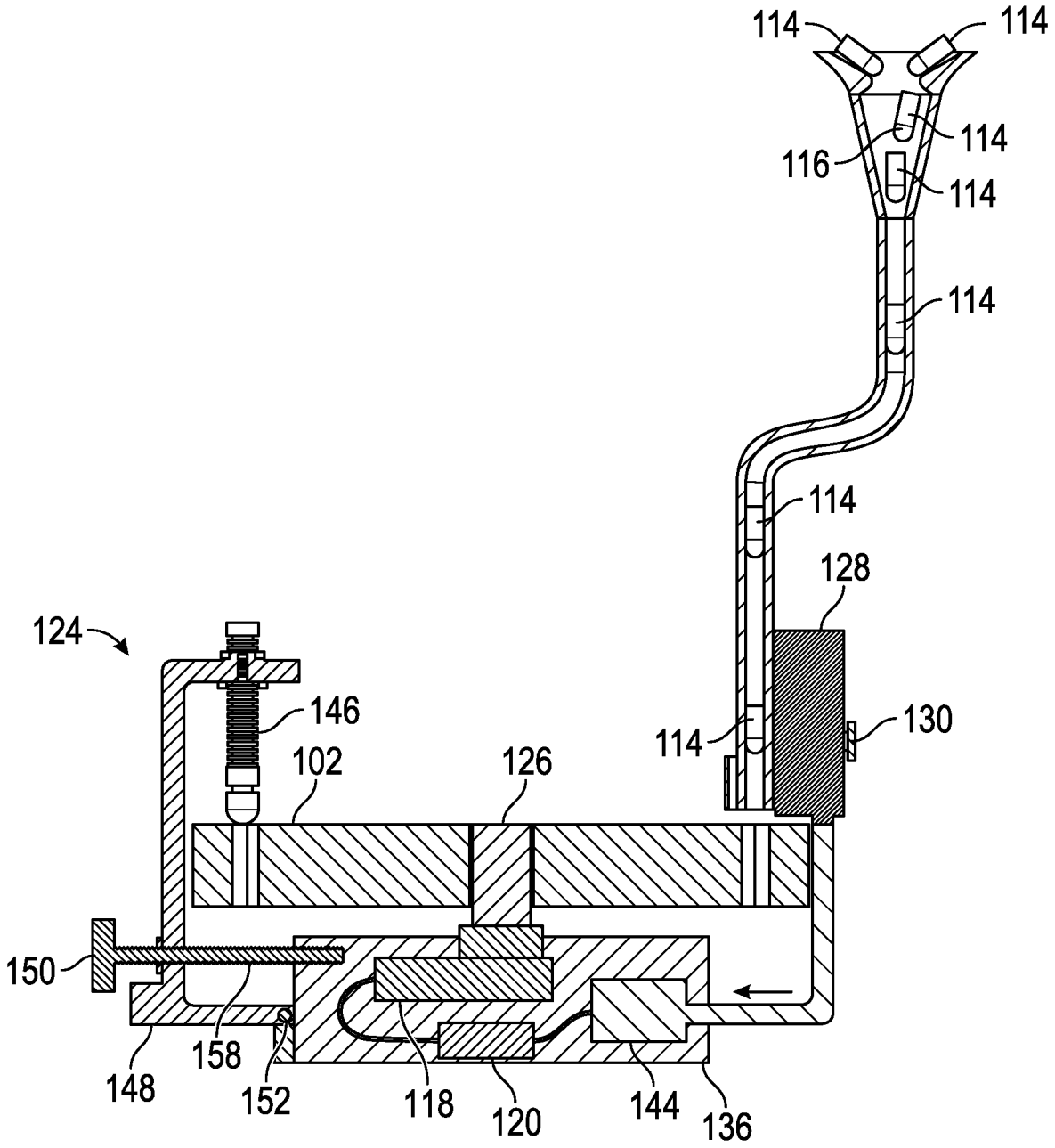
FIG. 4 presents a cross-sectional view of an auto-gauge ammunition inspection system in accordance with an illustrative embodiment of the present invention.

Turning our attention initially to FIGS. 1, 2, 3 and 4, an auto-gauge ammunition inspection system 100 is shown in accordance with an illustrative embodiment of the present invention. In particular, FIG. 1 presents a front, left isometric view of an auto-gauge ammunition inspection system 100, FIG. 2 presents a front, right isometric view of the auto-gauge ammunition inspection system 100, FIG. 3 presents an elevation view of the auto-gauge ammunition inspection system 100, and FIG. 4 presents a cross-sectional view of the auto-gauge ammunition inspection system 100. More particularly, cartridge case gauge plate 102 comprises a plurality of precision reamed cartridge chambers 104 embedded and fabricated therein. In the embodiment, the cartridge case gauge plate 102 has a circular shape having a first surface (i.e., top surface) and a second surface (i.e., bottom surface) whereby the plurality of precision reamed cartridge chambers 104 are configured along the circumference of the cartridge case gauge plate 102. Each precision reamed cartridge chamber 104 conforms with a specific ammunition caliber specification and accepts a particular one cartridge 114 of a plurality of cartridges (see, e.g., FIG. 4) in real-time from a cartridge loading apparatus (not shown) such as the Dillon Super 1050 loader/reloader (as available from Dillon Precision) with a Mark 7 auto drive that is capable of producing and loading high-volumes of handgun and rifle ammunition. Such cartridges are received from the cartridge loading device by a cartridge guide chute 106 which is similarly configured in accordance with the specific ammunition caliber specification. Thus, in accordance with the principles of the disclosed embodiments, the cartridge case gauge plate 102 and the cartridge guide chute 106 are a matched set and are interchangeable to conform with the desired ammunition caliber specification of the ammunition manufactured and inspected by the auto-gauge ammunition inspection system 100. In this way, a fully interchangeable and mated ammunition feeder and cartridge case gauge plate assembly are provided to easily and rapidly change between various ammunition calibers for the automatic testing and inspection of ammunition, and for confirming whether each respective cartridge of the plurality of cartridges conforms with the specific ammunition caliber specification. In an aspect, the specific ammunition caliber specifications hereunder are as promulgated by industry recognized standards organization such as SAMMI, NIST and/or NATO. As will be appreciated, ammunition is defined by and comprises one or more loaded cartridges consisting of a primed case, propellant, and projectile, and a cartridge is a unit of ammunition that comprises a cartridge case, primer, powder, and bullet.

The cartridge guide chute 106 is configured in a first position proximate to and above the cartridge case gauge plate 102 for receiving, orienting, and guiding each respective cartridge 114 of the plurality of cartridges such that each respective cartridge 114 is oriented in a nose down 116 (see, FIG. 4) orientation and travels along a path through the cartridge guide chute 106 for dropping into a particular one precision reamed cartridge chamber 104 of the plurality of precision reamed cartridge chambers in the cartridge case gauge plate 102. As shown, the cartridge guide chute 106 comprises a funnel 108 having a circular top portion and a narrow short tube bottom portion whereby the plurality of cartridges 114 are received by and fed into the circular top portion of the funnel 108. The funnel 108 is constructed from a metal material such that the cartridge guide chute 106 may be attached to the ammunition loader (or other apparatus supplying the plurality of cartridges 114 for inspection) using a magnetic-type fastener (not shown). The flexible spring tube portion 110 of the cartridge guide chute 106 has a first end and a second end facilitating the adjustment of the cartridge guide chute 106 into the first position proximate to and above the cartridge case gauge plate 102 given the ability of the flexible spring tube portion 110 to flex and bend accordingly.

Illustratively, the flexible spring tube portion 110 is made from a metal, flexible spring material and is approximately four hundred fifty-seven mm (eighteen (18) inches) in length such that the flexible tube portion 110 allows for the resizing of the cartridge guide chute 106 to adjust the first position proximate to and above the cartridge case gauge plate 102 as necessary to accommodate the specific ammunition being inspected given such ammunition will change in size depending upon the specific caliber thereof. A rigid tube portion 112 of the cartridge guide chute 106 has a first end and a second end such that the first end of the flexible spring tube portion 110 is connected with the short tube bottom portion of the funnel 108 and the second end of the flexible spring portion 110 is connected with the first end of the rigid tube portion 112 such that the plurality of cartridges 114 follow a path through the cartridge guide chute 106 and the second end of the rigid tube portion 112 allows for a respective cartridge 114 to drop into the particular one precision reamed cartridge chamber 104 of the plurality of precision reamed cartridge chambers in the cartridge case gauge plate 102 as the cartridge case gauge plate 102 passes thereunder.

In an embodiment, the rigid tube portion 112 is made of a transparent plastic material allowing the user to see the plurality of cartridges 114 passing through the cartridge guide chute 106. Illustratively, the rigid tube portion forms 112 allows for a stack of the respective cartridges of the plurality of cartridges 114 to be staged as they travel through the cartridge guide chute 106 and await dispensing and dropping into the particular one precision reamed cartridge chamber 104. As will be appreciated, the total number of cartridges 114 that may be stacked in this fashion will be a function of the ammunition size as stipulated in the particular ammunition caliber specification.

As shown, a cartridge guide chute bracket 132 comprising a channel 134 and an adjustable portion 128 for mechanically connecting the cartridge guide chute 106 to a base unit 136, the cartridge guide chute 106 being disposed within the channel 134. An adjustable locking bolt 130 is provided for adjusting the adjustable portion 128 of the cartridge guide chute bracket 132 for configuring the cartridge guide chute 106 in the first position proximate to and above the cartridge case gauge plate 102. The adjustable locking bolt 130 allows for adjusting the cartridge guide chute 106 (i.e., the channel 134 slides over the rigid tube portion 112 of the cartridge guide chute 106) to allow for the proper spacing of the first position proximate to and above the case gauge plate 102 to be achieved as a function of the caliber of the cartridges 114 under inspection.

In the embodiment, such motion is facilitated by a motor assembly 118 (see, FIGS. 3 and 4) coupled with the cartridge case gauge plate 102 by rotating shaft 126 and for driving the cartridge case gauge plate 102 in a revolving motion such that the particular one cartridge 114 of the plurality of cartridges drops from the cartridge guide chute 106 as the cartridge case gauge plate 102 revolves thereunder into the particular one precision reamed cartridge chamber 104 of the plurality of reamed cartridge chambers. Illustratively, the motor assembly 118, disposed within base unit 136 and communicatively/electrically couples with control board 120, comprises a 12 volt DC variable speed motor that allows for variable speed control of the cartridge case gauge plate 102 revolution. In this way, the motor assembly 118 may synchronize the cartridge case gauge plate 102 rotation with the speed of the particular cartridge loader being used to manufacture the ammunition. In some embodiments the motor assembly includes a stepper motor so that the control board 120 can monitor the exact rotational orientation of the cartridge case gauge plate 102 at any given time. Used in cooperation with a position switch at a known rotational position of the cartridge case gauge plate 120, the control board 120 can determine the precise rotational position of the cartridge case gauge plate 102 based on a number of steps sent to the stepper motor since the last closure of the position switch.

As will be appreciated, handgun ammunition is typically produced at faster rates than rifle ammunition making this synchronization feature necessary for effective operations. For example, in the embodiment shown, the auto-gauge ammunition inspection system 100 has been shown to achieve a running capacity of up to thirty-six hundred (3,600) handgun ammunition calibers per hour. Illustratively, the circular-shaped cartridge case gauge plate 102 comprises a total of six (6) precision reamed cartridge chambers 104 positioned in symmetric fashion about the circumference of the circular shape. As will be appreciated, this is only one of many possible variations and configurations for the cartridge case gauge plate 102 and the precision reamed cartridge chambers 104 comprised thereby that may be utilized in accordance with the principles of the disclosed embodiments herein.

As further shown, the auto-gauge ammunition inspection system 100 comprises a first testing station 122 that a particular one cartridge 114 is passed by cartridge case gauge plate 102 for a first set of inspection operations. The first testing station 122 comprising a micro-limit switch 138, micro-switch bracket 142, a push-pull solenoid 144, and a gate 140 controllable by the micro-limit switch 138 and the push-pull solenoid 144 (push-pull solenoids are on/off type actuators that develop force in one direction when energized with the return force being provided externally, by a return spring, for example) between an open gate position and a closed gate position depending upon whether the particular one cartridge 114 is accepted or rejected at this first testing station 122. As shown, the micro-limit switch 138 is in a second position proximate to and above the cartridge case gauge plate 102 and configured for detecting an improper cartridge case size condition and a high primer condition for the particular one cartridge 114 of the plurality of cartridges dropped into the particular one precision reamed cartridge chamber 104 from the cartridge guide chute 106 as the cartridge case gauge plate 102 revolves.

As will be appreciated, the overall length (OAL) of an ammunition cartridge is a measurement from the base of a brass shell casing to the tip of the cartridge, seated into the brass casing. Cartridge overall length (COL) is a crucial factor in the safe functioning of reloads in firearms. Hand-loaded cartridges and commercially available cartridges for firearms are normally created with a maximum length standardized by SAAMI, for example. The maximum overall length is dictated by the need to fit into a box magazine for the firearm of standard manufacture. For example, the 0.223 Remington cartridge, when loaded for use in the AR-15 rifle (or the military's M16 rifle), has to fit into the removable box magazine (i.e., a device for storing cartridges in a repeating firearm for loading into the chamber) for that rifle. This dictates that the cartridge's maximum overall length be no greater than 57 mm (2.260 inches). It is desirable for these single-loaded cartridges to have as little so-called cartridge jump as possible before the cartridge's ogive (i.e., the curve of a cartridge's forward section) begins to be engaged by the firearms lands (i.e., the raised portions between the grooves inside the barrel after the spiral grooves are cut to produce the rifling). This minimized cartridge jump increases the accuracy of the firearm (e.g., a rifle). As such, the cartridge's case is meant to match exactly to the chamber of the firearm that will fire the ammunition, and the cartridge case is essentially the container for all the other components that comprise the cartridge. For rifles and handguns, it is usually a metal cylindrical tube normally made of brass (but can also be steel) holding the cartridge at the neck, the propellant charge inside and the primer in the base thereof.

The first testing station 122 of the auto-gauge ammunition inspection system 100 is directed to the detection of either of the improper cartridge case size condition or a high primer condition of the ammunition thereby causing the particular one cartridge 114 to not fit exactly within the particular one precision reamed cartridge chamber 104 into which the particular one cartridge 114 of the plurality of cartridges has been dropped into from the cartridge guide chute 106.

An arm adjustment device can be set to the column. This provides a means of testing for a cartridge overall length. IN the event a "too long" cartridge is pushed up, triggering the limit switch, the cartridge 14 is ejected into the first bin.

These type of defects may manifest due to the mashing and/or cracking of the brass casing of the particular one cartridge 114, for example, thereby causing the particular one cartridge 114 to not fit in the particular one precision reamed cartridge chamber 104. That is, an "acceptable" cartridge case condition or primer condition hereunder is where the particular one precision reamed cartridge chamber 104 into which the particular one cartridge 114 has been dropped fits exactly therein and does not extend beyond the confines of the chamber such that the particular one cartridge 114 is flush with the top surface of the cartridge case gauge plate 102. In this way, if the particular one cartridge 114 does exhibit an improper cartridge case size, high primer condition, or has an excessive length as the particular one cartridge 114 passes through the first testing station 122 then the micro-limit switch 138 will be tripped (i.e., the operating or trip point thereof is where the contact change state from a normal, unoperated position) thereby actuating in turn the push-pull solenoid 144 which opens the gate 140 (having an initial closed position). Upon the gate 140 opening, the rejected/defective cartridge 114 is dropped into a first bin 172 (see, FIG. 7).

In accordance with the principles of the disclosed embodiments, the auto-gauge ammunition inspection system 100 further comprises a second testing station 124 the is configured for a second inspection of the plurality of cartridges 114 directed to the detection of missing primer and misoriented (i.e., upside-down) primer in any particular one cartridge 114. Thus, if the particular one cartridge 114 passes the inspection conducted by the first inspection station 122 then the particular one cartridge 114 continues travelling to the second testing station 124 for the missing primer and misoriented primer condition inspections. The second testing station 124 comprises a pair of pressure sensors 146 (having respective pressure feed tubes 154 tied thereto) for detecting the missing primer condition and/or the misoriented primer condition for the particular one cartridge 114 of the plurality of cartridges dropped into the particular one precision reamed cartridge chamber 104 from the cartridge guide chute 106 as the cartridge case gauge plate 102 revolves, but only if the particular one cartridge 114 was not ejected first by the first testing station 122. In the event of a defect detection (i.e., missing primer condition and/or misoriented primer condition), the pair of pressure sensors 146 are configured for immediately triggering a second push-pull solenoid, via the control board 120. Preferably one of the pressure sensors 146 detects the presence of the cartridge 114 thereunder, known as a PRESENT test, while the other pressure sensor 146 detects the missing primer condition and/or the misoriented primer condition, known as a VALIDITY test. In an alternate embodiment, a second solenoid (not shown) can be used to eject tested cartridges 114 that fail the VALIDITY test from the cartridge case gauge plate 102 in a similar manner as is done at the first testing station 122.

Figure 7:
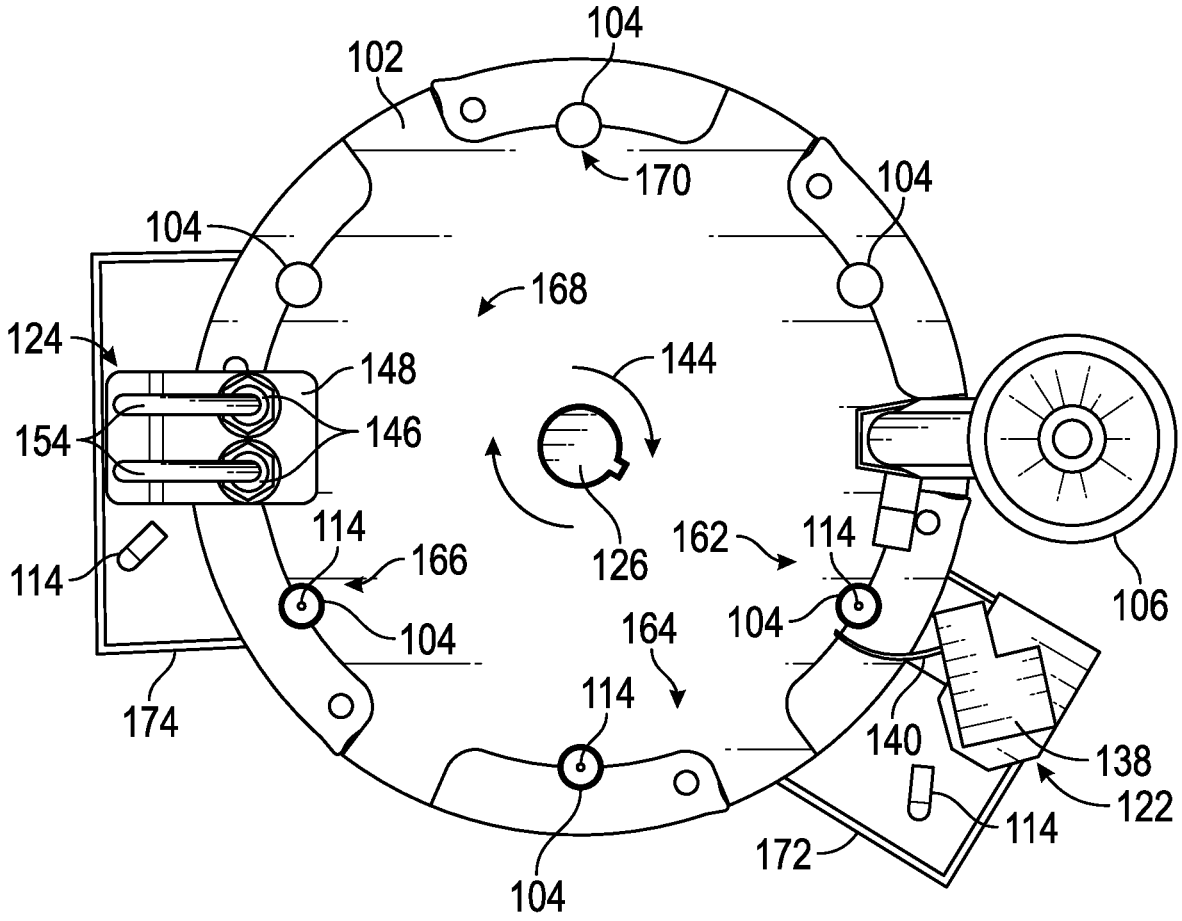
FIG. 7 presents a top elevation view of an auto-gauge ammunition inspection system as the ammunition loaded in FIG. 6 undergoes inspection for rejection or acceptance at the respective inspection stations in accordance with an illustrative embodiment of the present invention.

If no defect is detected by the second testing station 124 then the particular one cartridge 114 (i.e., a "good" cartridge) is removed (or dropped) into a third bin 174 (see, FIG. 7). In the subject embodiment, the second testing station 124 further comprises a pressure sensor bracket 148, and a threaded adjustment screw 158 having a wing nut 150 attached thereto for mechanically connecting and securing the second testing station 124 to the base unit 136 and positioning the pair of sensors 146 over the cartridge case gauge plate 102. A set of lock nuts 156 is provided for mechanically connecting the pair of pressure sensors 144 to the pressure sensor bracket 148. Hinge 152 facilitates a swinging movement of the pressure sensor bracket 148 about the base unit 136 in order to remove the cartridge case gauge plate 102 from the auto-gauge ammunition inspection system 100. Thus, the pressure sensor bracket 148 may swing out and away from the base unit 136 thereby allowing for the removal of one cartridge case gauge plate (e.g., a .38 caliber plate) and replacing it with another (e.g., a .357 caliber plate). As noted above, the auto-gauge ammunition inspection system 100 is configured for use with unique and matching cartridge case gauge plates and cartridge guide chutes to match the particular ammunition caliber as dictated by the applicable ammunition specification.

Figure 5:
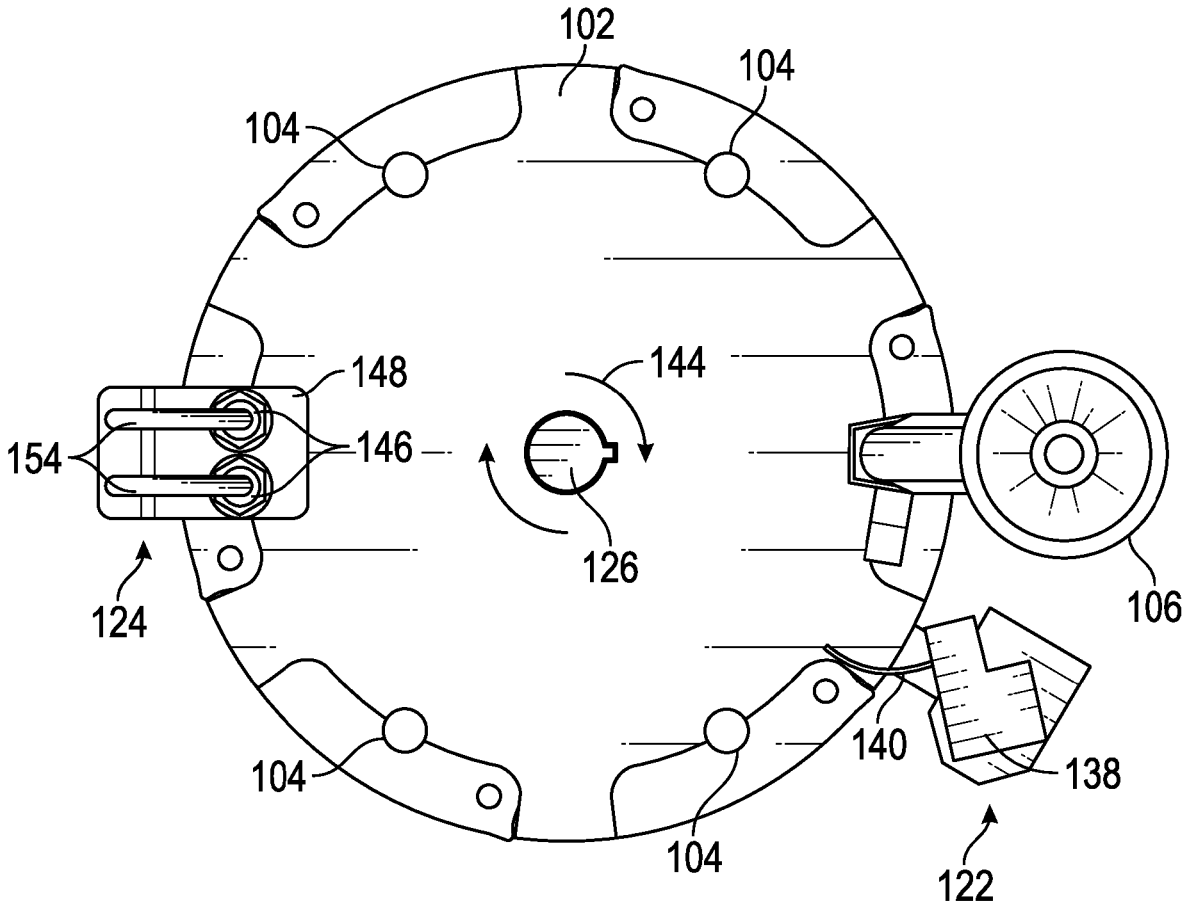
FIG. 5 presents a top elevation view of an auto-gauge ammunition inspection system in the ammunition loading configuration for the case gauge plate in accordance with an illustrative embodiment of the present invention.
Figure 6:
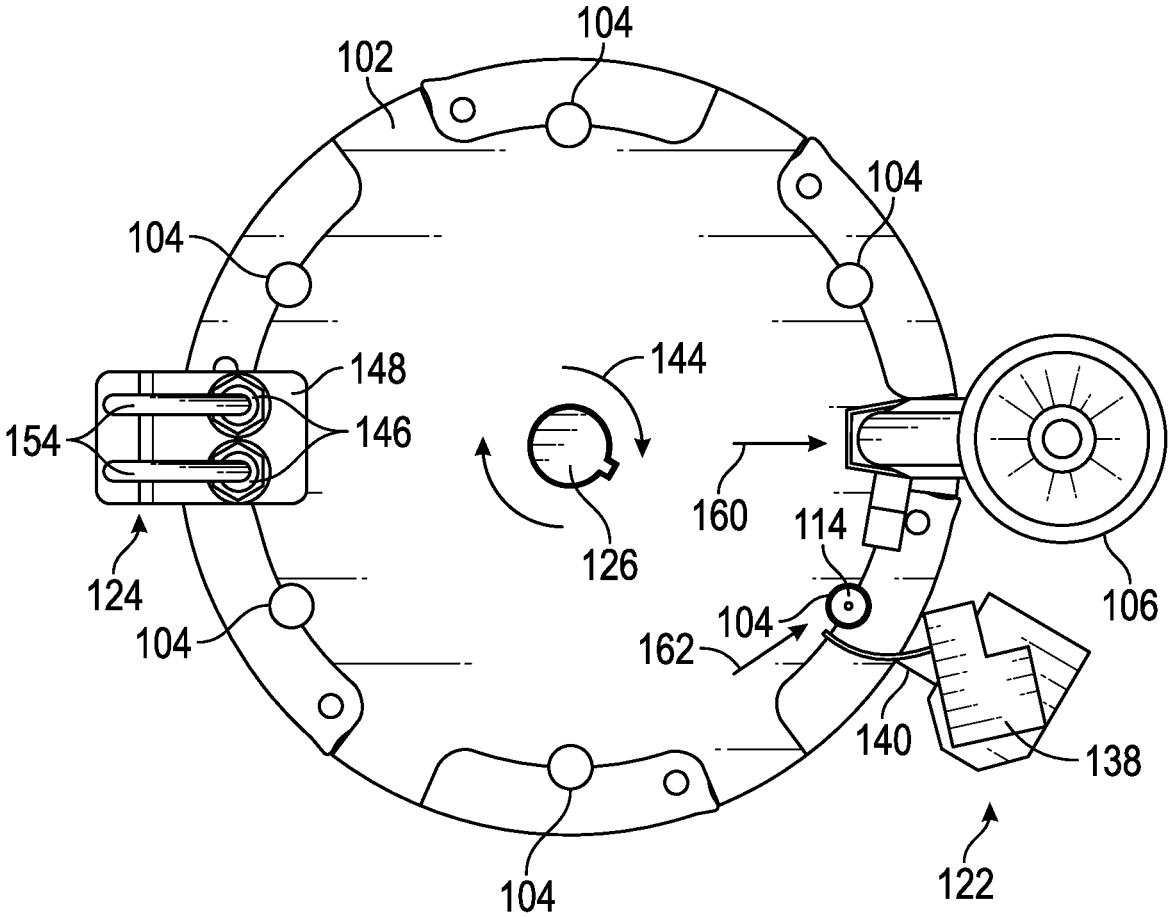
FIG. 6 presents a top elevation view of an auto-gauge ammunition inspection system as the ammunition is loaded in FIG. 5 and advances for inspection as the case gauge plate rotates in accordance with an illustrative embodiment of the present invention.

Turning our attention now to FIGS. 5-7, the above-detailed inspections aspects of the disclosed embodiment will be further discussed. More particularly, FIG. 5 presents a top elevation view of the auto-gauge ammunition inspection system 100 in the ammunition loading configuration as the case gauge plate 102 is awaiting population of the cartridges 114, FIG. 6 presents a top elevation view of the auto-gauge ammunition inspection system 100 as the ammunition (i.e., the cartridges 114) is loaded and advances for inspection as the case gauge plate rotates 102 in accordance with the illustrative embodiment of the present invention. FIG. 7 presents a top elevation view of the auto-gauge ammunition inspection system 100 as the ammunition loaded in FIG. 6 undergoes inspection for rejection or acceptance in accordance with an illustrative embodiment of the present invention. As shown in FIG. 5, the plurality of precision reamed cartridge chambers 104 are empty and awaiting loading from the cartridge guide chute 106. As shown in FIG. 6, a particular one cartridge 114 has been dropped, at position 160, in the respective precision reamed cartridge chamber 104, as detailed herein above, and already advanced to position 162 (in accordance circular rotation 144 of the case gauge plate 102) as the cartridge case gauge plate 102 rotates in a clockwise fashion (in accordance circular rotation 144 of the case gauge plate 102) towards and to the first inspection station 122.

For ease of illustration, only a single cartridge 114 is under discussion but it will be understood that multiple ones of the cartridges 114 are be dropped and loaded into the precision reamed cartridge chambers 104 such that the cartridge case gauge plate 102 is fully populated with cartridges 114 for inspection purpose. As shown in FIG. 7, the ammunition loaded in the cartridge case gauge plate 102 advances to the first testing station 122 and in the event that either an improper cartridge case size condition or a high primer condition is detected, or a cartridge 114 having an excessive length, as detailed herein above, the particular one cartridge 114 is rejected into and held by the first bin 172. If the particular one cartridge 114 passes the inspection conducted by the first inspection station 122 then the particular one cartridge 114 continues travelling, through positions 164 and 166, to the second testing station 124 for the missing primer and misoriented primer condition inspections at position 168.

As detailed above, if a missing primer or a misoriented primer condition is detected by the second testing station 124 then this immediately triggers a second push-pull solenoid ejecting the cartridge into the second bin 174, removing the particular one cartridge 114 (i.e., the "defective" cartridge) from the cartridge case gauge plate 102, and resetting the revolving motion of the cartridge case gauge plate 102. In the event no missing primer or a misoriented primer condition is detected by the second testing station 124, the particular one cartridge 114 (i.e., the "good" cartridge) is removed (or dropped) into the third bin 174. Upon completion of the inspection at the second testing station 124, the particular precision reamed cartridge chambers 104 advances, through position 170, again to the cartridge guide chute 106 for receiving of another one of the cartridges 114 for inspection.

Figure 9:
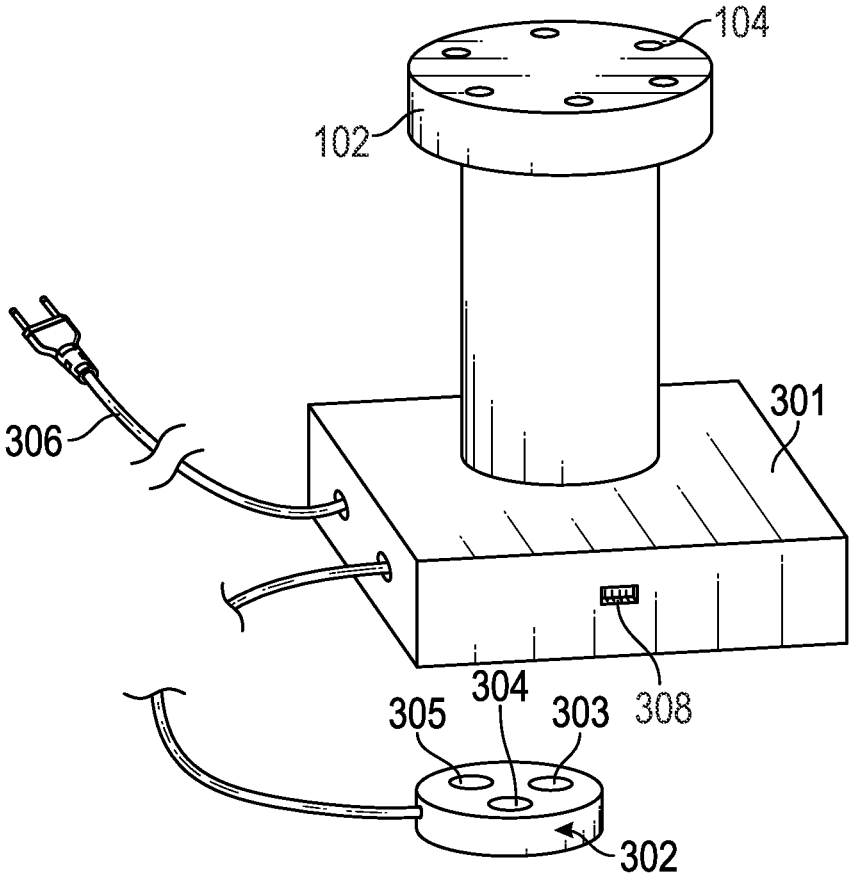
FIG. 9 is a perspective diagram of the invention, illustrating a remote control thereof Like reference numerals refer to like parts throughout the several views of the drawings.

In some embodiments, a remote control 302 (FIG. 9) is included that is electrically connected with the control board 120 through a flexible cable of any practical length. A start button 303 activates the testing process and the motor assembly 118. A stop button 304 terminates the testing process and halts the motor assembly 118. An audible alarm 305, and preferably a red indicator lamp at the stop button 304, is triggered by an error condition detected by the control board 120, which alerts a user to the error condition. To restart the testing process the user must correct the error condition, and then press the stop button 304 to reset the control board 120, and then press the start button 303 to activate the testing process again. Preferably the start button 303 is colored green, and the stop button 304 is colored red.

The remote control 302 provides the user with the ability to control the testing process quickly while paying close attention to the loading of the cartridges 114 into the cartridge guide chute 106, which may be some distance away from the cartridge case gauge plate 102 and the base unit 136.

In a second implementation of the invention, a method is provided for automating and increasing the efficiency of ammunition case gauge inspection and testing, the method comprising:

(i) receiving a plurality of cartridges (e.g., the plurality of cartridges 114); (ii) providing an auto-gauge ammunition inspection system (e.g., the auto-gauge ammunition inspection system 100) having a cartridge case gauge plate (e.g., the cartridge case gauge plate 102) comprising a plurality of precision reamed cartridge chambers (e.g., the plurality of precision reamed cartridge chambers 104) embedded and fabricated therein, each precision reamed cartridge chamber conforming with a specific ammunition caliber specification and accepting a particular one cartridge of the plurality of cartridges, and for confirming whether each respective cartridge of the plurality of cartridges conforms with the specific ammunition caliber specification; a cartridge guide chute, in a first position proximate to and above the cartridge case gauge plate, configured for use with the specific ammunition caliber specification and for receiving, orienting, and guiding each respective cartridge of the plurality of cartridges such that each respective cartridge travels along a path through the cartridge guide chute for dropping into a particular one precision reamed cartridge chamber of the plurality of precision reamed cartridge chambers in the cartridge case gauge plate; a motor assembly coupled with the cartridge case gauge plate and for driving the cartridge case gauge plate in a revolving motion such that the particular one cartridge of the plurality of cartridges drops from the cartridge guide chute as the cartridge case gauge plate revolves thereunder into the particular one precision reamed cartridge chamber of the plurality of reamed cartridge chambers; a first testing station (e.g., the first testing station 122) comprising a micro-limit switch, a push-pull solenoid, and a gate controllable by the micro-limit switch and the push-pull solenoid between an open gate position and a closed gate position, wherein the micro-limit switch is in a second position proximate to and above the cartridge case gauge plate and configured for detecting an improper cartridge case size condition and a high primer condition, or an excessive cartridge length condition for the particular one cartridge of the plurality of cartridges dropped into the particular one precision reamed cartridge chamber from the cartridge guide chute as the cartridge case gauge plate revolves, and in the event of the detection of either of the improper cartridge case size condition, the high primer condition, or the excessive length condition for the particular one cartridge activating the push-pull solenoid and placing the gate in the open gate position from the closed gate position for ejecting the particular one cartridge into a first bin (e.g., the first bin 172); and a second testing station (e.g., the second testing station 124) comprising a pair of pressure sensors for detecting a missing primer condition and a misoriented primer condition for the particular one cartridge of the plurality of cartridges dropped into the particular one precision reamed cartridge chamber from the cartridge guide chute as the cartridge case gauge plate revolves but only if the particular one cartridge was not ejected first by the first testing station, wherein the pair of pressure sensors are configured for triggering a second push-pull solenoid ejecting the cartridge 114 into the second bin 174, but if neither of the missing primer condition or the misoriented primer condition is detected then removing (or dropping) the particular one cartridge into a second bin (e.g., the second bin 174); and (iii) distributing contents of the first bin and the second bin.

Figure 8:
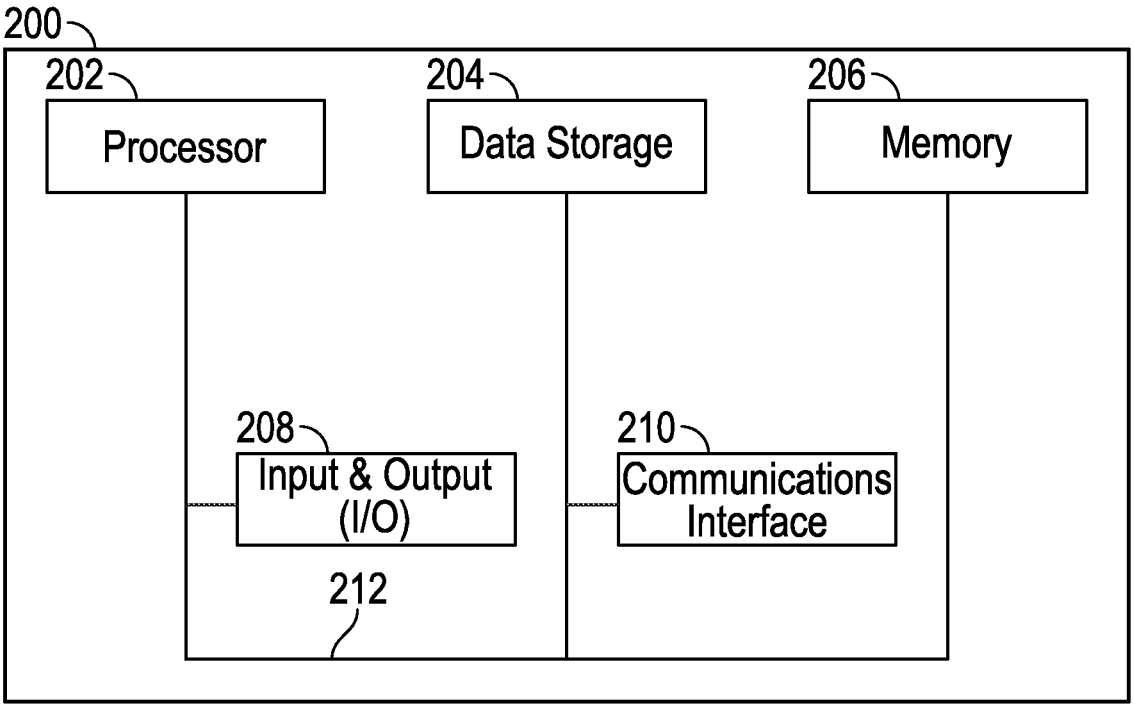
FIG. 8 presents a high-level block diagram of an exemplary computer for executing operations for automating and increasing the efficiency of ammunition case gauge inspection and testing in accordance with an illustrative embodiment of the present invention.

As detailed above, in some embodiments the method or methods described above may be executed or carried out by a computing system in combination with or integrated with the auto-gauge inspection system 100, preferably in the base unit 136, including a non-transitory computer-readable storage medium, also referred to as a storage machine, that holds machine-readable instructions executable by a logic machine (i.e., a processor or programmable control device) to provide, implement, perform, and/or enact the above-described methods, processes and/or tasks. For example, FIG. 8 is a high-level block diagram of an exemplary computer 200 for executing operations for automating and increasing the efficiency of ammunition case gauge inspection and testing in accordance with an illustrative embodiment of the present invention. The exemplary computer 200 comprises a processor 202 operatively coupled to a data storage device 204 and a memory 206. Processor 202 controls the overall operation of computer 200 by executing computer program instructions that define such operations. Communications bus 212 facilitates the coupling and communication between the various components of computer 200. The computer program instructions may be stored in data storage device 204, or a non-transitory computer readable medium, and loaded into memory 206 when execution of the computer program. instructions is desired.

The associated discussion herein above can be defined by the computer program instructions stored in memory 206 and/or data storage device 204 and controlled by processor 202 executing the computer program instructions. For example, the computer program instructions can be implemented as computer executable code programmed by one skilled in the art to perform the illustrative operations defined by the disclosed methods. Further, it will be appreciated that any flowcharts, flow diagrams, state transition diagrams, pseudo code, program code and the like represent various processes which may be substantially represented in computer readable medium and so executed by a computer, machine, or processor, whether or not such computer, machine or processor is explicitly shown. One skilled in the art will recognize that an implementation of an actual computer or computer system may have other structures and may contain other components as well, and that a high level representation of some of the components of such a computer is for illustrative purposes.

Accordingly, by executing the computer program instructions, processor 202 executes an algorithm defined by the disclosed method. Computer 200 also includes one or more communications interface 210 for communicating with other devices via a network (e.g., a wireless communications network) or communications protocol (e.g., Bluetooth®). For example, such communication interfaces may be a receiver, transceiver, or modem for exchanging wired or wireless communications in any number of well-known fashions. Computer 200 also includes one or more input/output devices 308 (FIG. 9) that enable user interaction with computer 200 (e.g., camera, display, keyboard, mouse, speakers, microphone, buttons, etc.). Processor 202 may include both general and special purpose microprocessors and may be the sole processor or one of multiple processors of computer 200. Processor 202 may comprise one or more central processing units (CPUs), for example. Processor 202, data storage device 204, and/or memory 206 may include, be supplemented by, or incorporated in, one or more application-specific integrated circuits (ASICs) and/or one or more field programmable gate arrays (FPGAs).

Data storage device 204 and memory 206 each comprise a tangible non-transitory computer readable storage medium. Data storage device 204, and memory 206, may each include high-speed random access memory, such as dynamic random access memory (DRAM), static random access memory (SRAM), double data rate synchronous dynamic random access memory (DDR RAM), or other random access solid state memory devices, and may include non-volatile memory, such as one or more magnetic disk storage devices such as internal hard disks and removable disks, magneto-optical disk storage devices, optical disk storage devices, flash memory devices, semiconductor memory devices, such as erasable programmable read-only memory (EPROM), electrically erasable programmable read-only memory (EEPROM), compact disc read-only memory (CD-ROM), digital versatile disc read-only memory (DVD-ROM) disks, or other non-volatile solid state storage devices. Input/output devices 308 may include interface connectors such as USB ports for peripherals, such as a camera, printer, scanner, display screen, etc. For example, input/output devices 1008 may include a display device such as a cathode ray tube (CRT), plasma or liquid crystal display (LCD) monitor for displaying information to the user, a keyboard, and a pointing device such as a mouse or a trackball by which the user can provide input to computer 200.

The exemplary computer 200, with suitable software instructions, can provide an ammunition manufacturing facility the ability to manage the production of ammunition cartridges 14 in real time, manage a list of required components for assembling the cartridges 14, prepare schedules of production by caliber either by day, week, month, and/or year, be alerted quickly to loader machine failures, provide financial data and status of the ammunition manufacturing facility, provide ammunition production quality and rejected quantities reports, provide interactive customer shipping and invoices functions, and the like.

Thus, the steps of the disclosed method and the associated discussion herein above can be defined by the computer program instructions stored in a memory and/or data storage device and controlled by a processor executing the computer program instructions. Accordingly, by executing the computer program instructions, the processor executes an algorithm defined by the disclosed method. For example, the computer program instructions can be implemented as computer executable code programmed by one skilled in the art to perform the illustrative operations defined by the disclosed methods. Further, it will be appreciated that any flowcharts, flow diagrams, state transition diagrams, pseudo code, program code and the like represent various processes which may be substantially represented in computer readable medium and so executed by a computer, machine, or processor, whether or not such computer, machine or processor is explicitly shown. One skilled in the art will recognize that an implementation of an actual computer or computer system may have other structures and may contain other components as well, and that a high-level representation of some of the components of such a computer is for illustrative purposes.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An auto-gauge ammunition inspection system comprising:

a cartridge case gauge plate comprising a plurality of precision reamed cartridge chambers embedded and fabricated therein, each precision reamed cartridge chamber conforming with a specific ammunition caliber specification and accepting a particular one cartridge of a plurality of cartridges, and for confirming whether each respective cartridge of the plurality of cartridges conforms with the specific ammunition caliber specification;

a cartridge guide chute, in a first position proximate to and above the cartridge case gauge plate, configured for use with the specific ammunition caliber specification and for receiving, orienting, and guiding each respective cartridge of the plurality of cartridges such that each respective cartridge travels along a path through the cartridge guide chute for dropping into a particular one precision reamed cartridge chamber of the plurality of precision reamed cartridge chambers in the cartridge case gauge plate;

a motor assembly coupled with the cartridge case gauge plate and for driving the cartridge case gauge plate in a revolving motion such that the particular one cartridge of the plurality of cartridges drops from the cartridge guide chute as the cartridge case gauge plate revolves thereunder into the particular one precision reamed cartridge chamber of the plurality of reamed cartridge chambers;

a first testing station comprising a micro-limit switch, a push-pull solenoid, and a gate controllable by the micro-limit switch and the push-pull solenoid between an open gate position and a closed gate position, wherein the micro-limit switch is in a second position proximate to and above the cartridge case gauge plate and configured for detecting an improper cartridge case size condition, a high primer condition, or a cartridge excessive length condition for the particular one cartridge of the plurality of cartridges dropped into the particular one precision reamed cartridge chamber from the cartridge guide chute as the cartridge case gauge plate revolves, and in the event of a detection of either of the improper cartridge case size condition, the high primer condition, or the excessive cartridge length condition for the particular one cartridge, activating the push-pull solenoid and placing the gate in the open gate position from the closed gate position for ejecting the particular one cartridge into a first bin; and a second testing station comprising a pair of pressure sensors for detecting a missing primer condition and a misoriented primer condition for the particular one cartridge of the plurality of cartridges dropped into the particular one precision reamed cartridge chamber from the cartridge guide chute as the cartridge case gauge plate revolves but only if the particular one cartridge was not ejected first by the first testing station, wherein the pair of pressure sensors are configured for triggering a second solenoid in an event of a detection of the missing primer condition or the misoriented primer condition for a removal of the particular one cartridge into a second bin and resetting the cartridge case gauge plate, but if neither of the missing primer condition or the misoriented primer condition is detected then removing the particular one cartridge into a third bin.

2. The auto-gauge ammunition inspection system of claim 1 wherein the cartridge case gauge plate comprises a circular shape and the plurality of precision reamed cartridge chambers comprise six (6) precision reamed cartridge chambers positioned in symmetric fashion about a circumference of the circular shape.

3. The auto-gauge ammunition inspection system of claim 1 wherein the specific ammunition caliber specification is a Sporting Arms and Ammunition Manufacturers' Institute (SAAMI) ammunition specification, a National Institute of Standards and Technology (NIST) ammunition specification, or a North Atlantic Treaty Organization (NATO) ammunition specification.

4. The auto-gauge ammunition inspection system of claim 1 wherein the plurality of cartridges are received by the cartridge guide chute from a cartridge loader.

5. The auto-gauge ammunition inspection system of claim 1 wherein the cartridge guide chute further comprises: a funnel having a circular top portion and a narrow short tube bottom portion; a flexible spring tube portion having a first end and a second end facilitating adjusting of the first position proximate to and above the cartridge case gauge plate for the cartridge guide chute; a rigid tube portion having a first end and a second end; and wherein the first end of the flexible spring tube portion is connected with the short tube bottom portion of the funnel and the second end of the flexible spring portion is connected with the first end of the rigid tube portion.

6. The auto-gauge ammunition inspection system of claim 1 the cartridge guide chute orients and guides each respective cartridge of the plurality of cartridges in a nose-down position along the path through the cartridge guide chute as each respect cartridge travels therethrough.

7. The auto-gauge ammunition inspection system of claim 5 wherein the rigid tube portion forms a stack of the respective cartridges of the plurality of cartridges travelling through the cartridge guide chute.

8. The auto-gauge ammunition inspection system of claim 7 wherein the particular one cartridge drops from the stack of cartridges into the particular one precision reamed cartridge chamber from the cartridge guide chute as the cartridge case gauge plate revolves thereunder.

9. The auto-gauge ammunition inspection system of claim 1 wherein the motor assembly uses a variable speed in the driving of the cartridge case gauge plate in a revolving motion.

10. The auto-gauge ammunition inspection system of claim 1 wherein the first bin is configured for storing one or more rejected cartridges from the plurality of cartridges as non-compliant with the specific ammunition caliber specification, the second bin is configured to hold rejected cartridges, and the third bin is configured for storing one or more accepted cartridges from the plurality of cartridges as compliant with the specific ammunition caliber specification.

11. The auto-gauge ammunition inspection system of claim 1 wherein the second testing station triggers a second push-pull solenoid ejecting the cartridge into a second bin, in the event of the detection of either of the missing primer condition or the misoriented primer condition.

12. The auto-gauge ammunition inspection system of claim 1 wherein the improper case size condition, the high primer condition, or a cartridge excessive length condition for the particular one cartridge of the plurality of cartridges exists when the particular one cartridge of the plurality of cartridges dropped into the particular one precision reamed cartridge chamber from the cartridge guide chute as the cartridge case gauge plate revolves thereunder extends beyond the particular one precision reamed cartridge chamber.

13. The auto-gauge ammunition inspection system of claim 1 wherein the auto-gauge ammunition inspection system further comprises: a control board for controlling at least the motor assembly and the push-pull solenoid; and a base unit mechanically connected by a shaft with the cartridge case gauge plate for holding the control board, the motor assembly, and the push-pull solenoid therein, the shaft configured for being driven by the motor assembly.

14. The auto-gauge ammunition inspection system of claim 13 wherein the second testing station further comprises: a pressure sensor bracket for mechanically connecting the second testing station to the base unit; a threaded adjustment screw comprising a wing nut for driving the threaded adjustment screw into the base unit; a set of lock nuts for mechanically connecting the pair of pressure sensors to the pressure sensor bracket; and a hinge for facilitating a swinging movement of the pressure sensor bracket about the base unit in order to remove the cartridge case gauge plate from the auto-gauge ammunition inspection system.

15. The auto-gauge ammunition inspection system of claim 13 wherein the first testing station further comprises: a micro-switch bracket having a channel for mechanically connecting the first testing station to the base unit.

16. The auto-gauge ammunition inspection system of claim 13 wherein the auto-gauge ammunition inspection system further comprises: a cartridge guide chute bracket comprising a channel and an adjustable portion for mechanically connecting the cartridge chute to the base unit, the cartridge chute being disposed within the channel; and an adjustable locking bolt for adjusting the adjustable portion of the cartridge guide chute bracket for configuring the cartridge guide chute in the first position proximate to and above the cartridge case gauge plate.

17. The auto-gauge ammunition inspection system of claim 1 wherein the motor assembly includes a stepper motor and a position switch at a known rotational position of the cartridge case gauge plate, a control board determining a rotational position of the cartridge case gauge plate based on a number of steps sent to the stepper motor since the last closure of the position switch.

18. The auto-gauge ammunition inspection system of claim 1 further including a remote control electrically connected with a control board through a flexible cable, the remote control including a start button that activates a testing process and the motor assembly; a stop button that terminates the testing process and halts the motor assembly; an audible alarm; and a red indicator lamp at the stop button that is triggered by an error condition detected by the control board.

19. A method for automating and increasing the efficiency of ammunition case gauge inspection and testing, the method comprising the steps:

(i) receiving a plurality of cartridges from a cartridge loader;

(ii) providing an auto-gauge ammunition inspection system comprising a cartridge case gauge plate comprising a plurality of precision reamed cartridge chambers embedded and fabricated therein, each precision reamed cartridge chamber conforming with a specific ammunition caliber specification and accepting a particular one cartridge of the plurality of cartridges, and for confirming whether each respective cartridge of the plurality of cartridges conforms with the specific ammunition caliber specification; a cartridge guide chute, in a first position proximate to and above the cartridge case gauge plate, configured for use with the specific ammunition caliber specification and for receiving, orienting, and guiding each respective cartridge of the plurality of cartridges such that each respective cartridge travels along a path through the cartridge guide chute for dropping into a particular one precision reamed cartridge chamber of the plurality of precision reamed cartridge chambers in the cartridge case gauge plate; a motor assembly coupled with the cartridge case gauge plate and for driving the cartridge case gauge plate in a revolving motion such that the particular one cartridge of the plurality of cartridges drops from the cartridge guide chute, as the cartridge case gauge plate revolves thereunder, into the particular one precision reamed cartridge chamber of the plurality of reamed cartridge chambers; a first testing station comprising a micro-limit switch, a push-pull solenoid, and a gate controllable by the micro-limit switch and the push-pull solenoid between an open gate position and a closed gate position, wherein the micro-limit switch is in a second position proximate to and above the cartridge case gauge plate and configured for detecting an improper cartridge case size condition, a high primer condition, or a cartridge excessive length condition for the particular one cartridge of the plurality of cartridges dropped into the particular one precision reamed cartridge chamber from the cartridge guide chute as the cartridge case gauge plate revolves, and in the event of the detection of the improper cartridge case size condition, the cartridge excessive length condition, or the high primer condition for the particular one cartridge activating the push-pull solenoid and placing the gate in the open gate position from the closed gate position for ejecting the particular one cartridge into a first bin; and a second testing station comprising a pair of pressure sensors for detecting a missing primer condition and a misoriented primer condition for the particular one cartridge of the plurality of cartridges dropped into the particular one precision reamed cartridge chamber from the cartridge guide chute as the cartridge case gauge plate revolves, but only if the particular one cartridge was not ejected first by the first testing station, wherein the pair of pressure sensors are configured for triggering a second push-pull solenoid, in the event of the detection of either of the missing primer condition or the misoriented primer condition for a removal of the particular one cartridge and resetting the cartridge case gauge plate, but if neither of the missing primer condition or the misoriented primer condition is detected then removing the particular one cartridge into a second bin; and (iii) distributing contents of the first bin and the second bin.

* * * * *